United States Patent [19]

Binversie et al.

[11] Patent Number: 5,049,098

[45] Date of Patent: Sep. 17, 1991

[54] MARINE PROPULSION DEVICE WITH TILT AND TRIM ASSEMBLY INCLUDING ROLLER TRANSMITTED THRUST

[75] Inventors: Gregory J. Binversie, Grayslake, Ill.; Joseph E. Capodarco, Kenosha, Wis.; James R. DeRam, Libertyville, Ill.; H. Norman Petersen, Kenosha, Wis.

[73] Assignee: Outboard Marine Corporation, Waukegan, Ill.

[21] Appl. No.: 523,321

[22] Filed: May 14, 1990

[51] Int. Cl.[5] ..... B63H 21/26

[52] U.S. Cl. ..... 440/61

[58] Field of Search ..... 440/61, 55; 248/642, 248/643; 92/146; 91/508, 533

[56] References Cited

U.S. PATENT DOCUMENTS

| | | | |
|---|---|---|---|
| 3,722,455 | 3/1973 | Carpenter | 115/41 HT |
| 3,986,434 | 10/1976 | Kohler | 92/146 X |
| 4,064,824 | 12/1977 | Hall et al. | 115/41 HT |
| 4,096,820 | 6/1978 | Hall | 115/41 HT |
| 4,391,592 | 7/1983 | Hundertmark | 440/61 |
| 4,449,945 | 5/1984 | Ferguson | 440/53 |
| 4,720,278 | 1/1988 | Taguchi et al. | 440/61 |
| 4,764,134 | 8/1988 | Watanabe | 440/53 |
| 4,786,263 | 11/1988 | Burmeister et al. | 440/53 |

*Primary Examiner*—Sherman Basinger

*Attorney, Agent, or Firm*—Michael, Best & Friedrich

[57] ABSTRACT

Disclosed herein is a marine propulsion device comprising a transom bracket adapted to be mounted on a boat transom and including a pair of laterally spaced elements, a swivel bracket supported from the transom bracket for pivotal movement about a horizontal tilt axis and through a trim range and a tilt range extending upwardly from the trim range, which swivel bracket includes a portion which extends generally vertically when the swivel bracket is in the trim range and which includes an unbroken rearward surface extending between the transfer bracket elements and a projection extending forwardly therefrom, a roller supported by the projection for rotation about a horizontal axis parallel to the tilt axis, a hydraulic tilt and trim assembly comprising a tilt hydraulic cylinder/piston assembly comprising a tilt cylinder pivotally connected to the transom bracket and a tilt piston rod pivotally connected to the swivel bracket, and a trim hydraulic cylinder/piston assembly comprising a trim cylinder fixedly connected to the tilt cylinder for common movement therewith, and a trim piston rod extending toward the roller and engageable therewith when the swivel bracket is in the trim range and being spaced therefrom when the swivel bracket is in the tilt range, and a propulsion unit supported by the swivel bracket for common movement therewith about the tilt axis and for pivotal steering movement relative to the swivel bracket about a steering axis transverse to the tilt axis and including a propeller shaft adapted to have mounted thereon a propeller.

8 Claims, 6 Drawing Sheets

MARINE PROPULSION DEVICE WITH TILT AND TRIM ASSEMBLY INCLUDING ROLLER TRANSMITTED THRUST

BACKGROUND OF THE INVENTION

1. Field of the Invention

The invention relates generally to marine propulsion devices such as outboard motors and stern drive units. More particularly the invention relates to arrangements for constructing trim and tilt cylinder/piston assemblies, and to arrangements for transmitting forward thrust from a swivel bracket to the piston rod of a trim cylinder/piston assembly.

2. Reference to Prior Art

It is known to pivotally connect a swivel bracket to a transom bracket for pivotal movement thereof about a horizontal tilt axis and from a lowermost running position through a trim range and upwardly from the upper end of the trim range through a tilt range to a fully tilted or raised position. It is also known to pivotally connect a tilt cylinder/piston assembly to both the transom bracket and the swivel bracket and to employ a trim cylinder/piston assembly which is supported by the transom bracket and which includes a rearwardly extending trim piston rod having an outer end which is releasably engageable with the swivel bracket for receipt of thrust therefrom during forward propulsion when in the trim range. It is also known that, during movement of the swivel bracket through the trim range, the outer end of the trim piston rod travels radially of the tilt axis in relation to the swivel bracket.

Attention is directed to U.S. Pat. Nos. 4,720,278, issued Jan. 19, 1988, and 4,764,134, issued Aug. 16, 1988, which patents disclose prior arrangements for transmitting forward thrust from a swivel bracket to the piston rod of a trim cylinder/piston assembly.

Attention is also directed to U.S. Pat. No. 4,786,263, issued Mar. 22, 1988 and to U.S. application Ser. No. 403,985, filed Sept. 6, 1989, now U.S. Pat. No. 4,925,411 which disclose hydraulic cylinder/piston assemblies pivotally mounted between a swivel bracket and a transom bracket.

Still further in addition, attention is directed to Hall U.S. Pat. Nos. 4,064,824, issued Dec. 27, 1977 and 4,096,820, issued June 27, 1978, as well as to U.S. Carpenter U.S. Pat. No. 3,722,455, issued Mar. 27, 1973, which patents disclose a pair of trim cylinder/piston assemblies having outer ends which releasably engage a swivel bracket.

Still further in addition, attention is directed to U.S. Pat. No. 4,449,945, issued May 22, 1984, which discloses a trim cylinder/piston assembly pivoted by gear sectors in response to pivotal movement of a tilt cylinder/piston assembly in order to minimize movement radially of the tilt axis of the outer end of the trim piston rod relative to the swivel bracket.

SUMMARY OF THE INVENTION

The invention provides a marine propulsion device comprising a transom bracket adapted to be mounted on a boat transom, a swivel bracket supported from the transom bracket for pivotal movement about a horizontal tilt axis and relative to a trim range and a tilt range extending upwardly from the trim range, a thrust roller supported by the swivel bracket for rotation about a horizontal axis parallel to the tilt axis, a trim cylinder/piston assembly supported by the transom bracket and including a trim cylinder and a trim piston rod having an outer end surface engageable with the thrust roller throughout movement of said swivel bracket in the trim range, and a propulsion unit supported by the swivel bracket for common movement therewith about the tilt axis and for pivotal steering movement relative to the swivel bracket about a steering axis transverse to the tilt axis and including a propeller shaft adapted to have mounted thereon a propeller.

The invention also provides a marine propulsion device comprising a transom bracket adapted to be mounted on a boat transom and including a pair of laterally spaced elements, a swivel bracket supported from the transom bracket for pivotal movement about a horizontal tilt axis and through a trim range and a tilt range extending upwardly from the trim range, which swivel bracket includes a portion which extends generally vertically when the swivel bracket is in the trim range, which portion includes an unbroken rearward surface extending between the transfer bracket elements, and a pair of projections extending forwardly therefrom in laterally spaced relation to each other, a roller supported by the projections for rotation about a horizontal axis parallel to said the axis, a hydraulic tilt and trim assembly comprising a tilt hydraulic cylinder/piston assembly comprising a tilt cylinder pivotally connected to the transom bracket and a tilt piston rod pivotally connected to the swivel bracket, and a trim hydraulic cylinder/piston assembly comprising a trim cylinder fixedly connected to the tilt cylinder for common movement therewith and a trim piston rod extending toward the roller and engageable therewith when the swivel bracket is in the trim range and being spaced therefrom when the swivel bracket is in the tilt range, and a propulsion unit supported by the swivel bracket for common movement therewith about the tilt axis and for pivotal steering movement relative to the swivel bracket about a steering axis transverse to the tilt axis and including a propeller shaft adapted to have mounted thereon a propeller.

Other features and advantages of the invention will become apparent to those skilled in the art upon review of the following detailed description, claims, and drawings.

THE DRAWINGS

Figure 1:
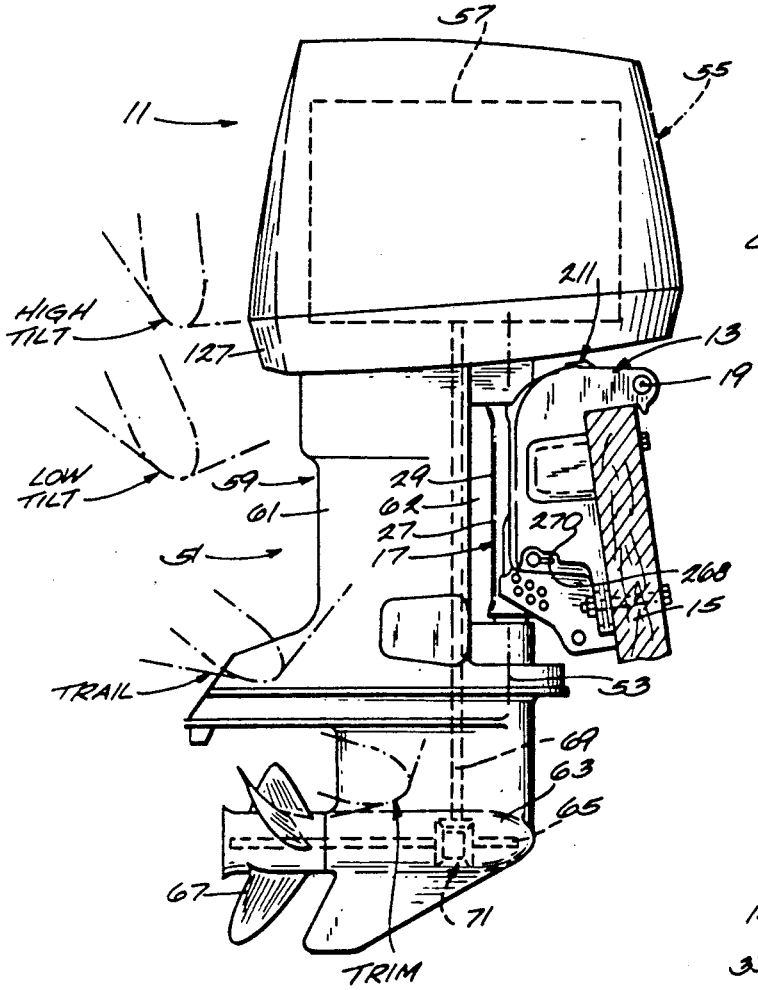
FIG. 1 is a starboard side elevational view of a marine propulsion device incorporating various of the features of the invention.
Figure 22:
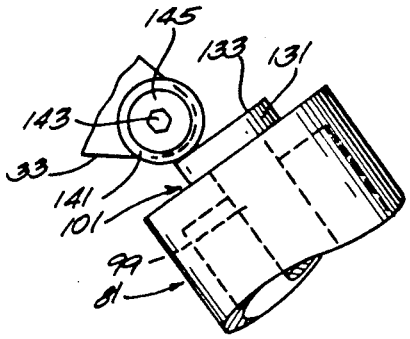
FIG. 22 is an enlarged fragmentary view, partially in section, of a portion of the marine propulsion device shown in FIG. 1.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Figure 4:
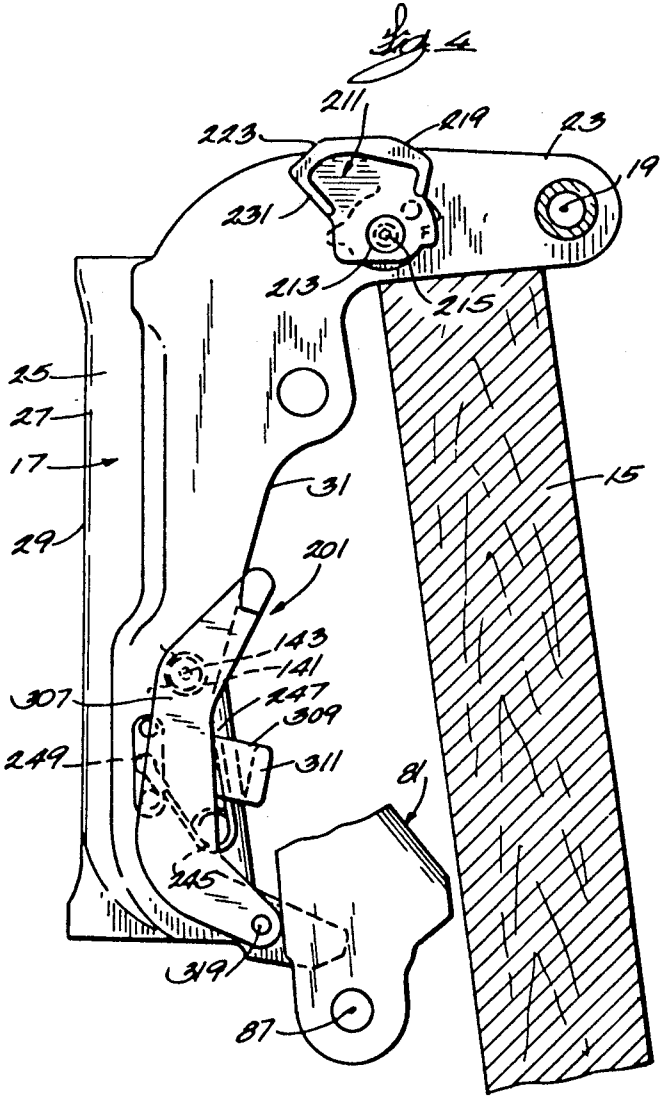
FIG. 4 is a view similar to FIG. 3, but with portions omitted and illustrating the starboard side of the swivel bracket incorporated in the marine propulsion device shown in FIG. 1.

Shown in FIG. 1 of the drawings is a marine propulsion device which is in the form of an outboard motor 11 although various of the features of the invention are also applicable to stern drive units. The outboard motor 11 includes a transom bracket 13 adapted to be fixedly mounted to the transom 15 of a boat, and (see FIGS. 3 through 5) a swivel bracket 17 which is pivotally mounted on the transom bracket 13 for vertical tilting movement about a horizontal tilt axis 19 from a lowermost running position (shown in FIG. 1) to a fully raised tilt position, i.e., through a trim range beginning at the lowermost running position, and through a tilt range extending from the upper end of the trim range and to a fully raised tilt position.

Figure 3:
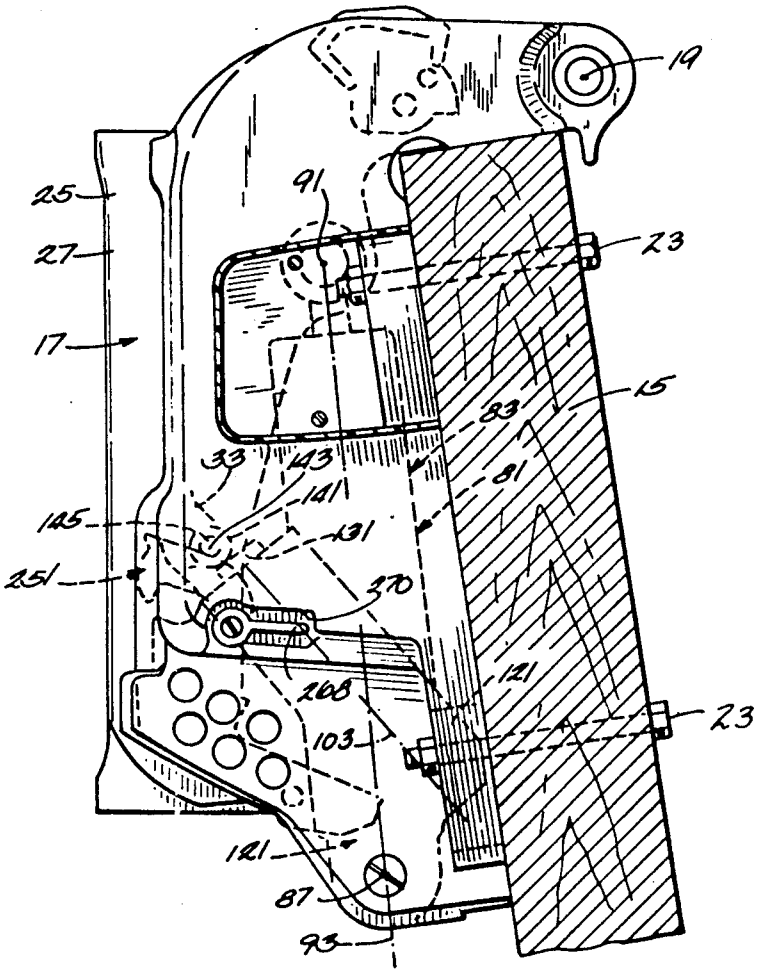
FIG. 3 is an enlarged side elevational view of a portion of the starboard side of the marine propulsion device shown in FIG. 1.

More particularly, the transom bracket 13 can be of any suitable construction and comprises (see FIG. 20) a pair of horizontally spaced port and starboard bracket portions or elements 21 and 22, respectively, which are individually fixed to the boat transom 15 by any suitable means such as bolts 23 (FIG. 3).

Figure 21:
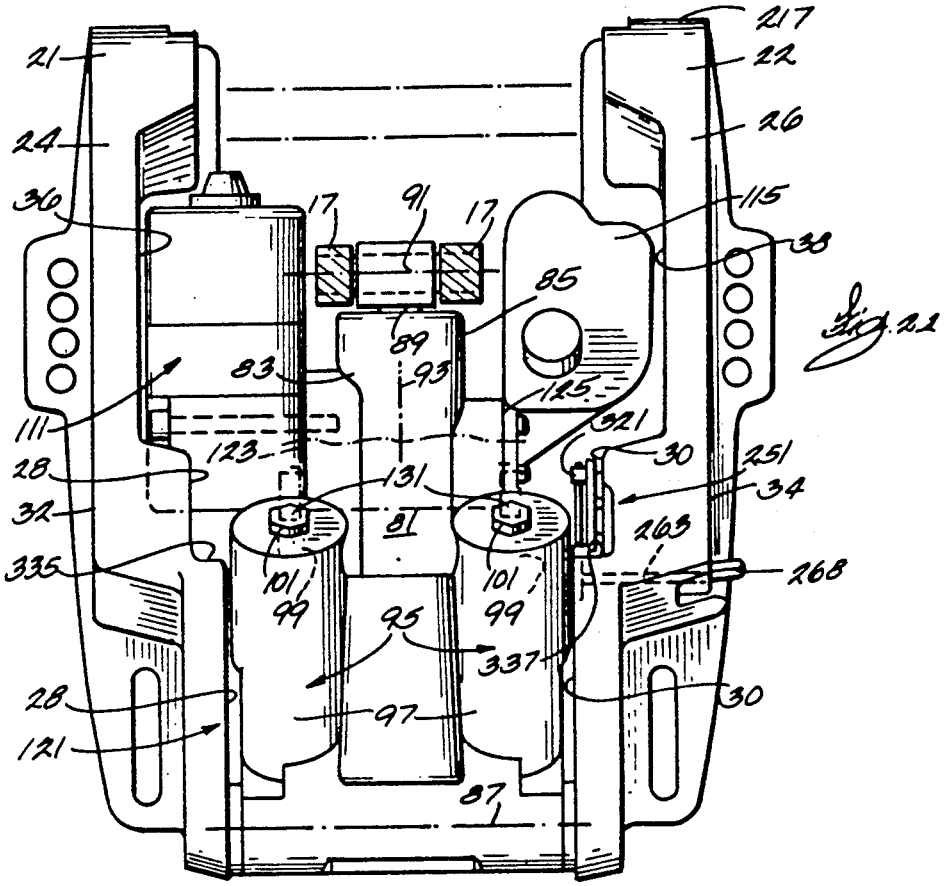
FIG. 21 is an enlarged view similar to FIG. 20 and with the swivel bracket and trail arm omitted.
Figure 20:
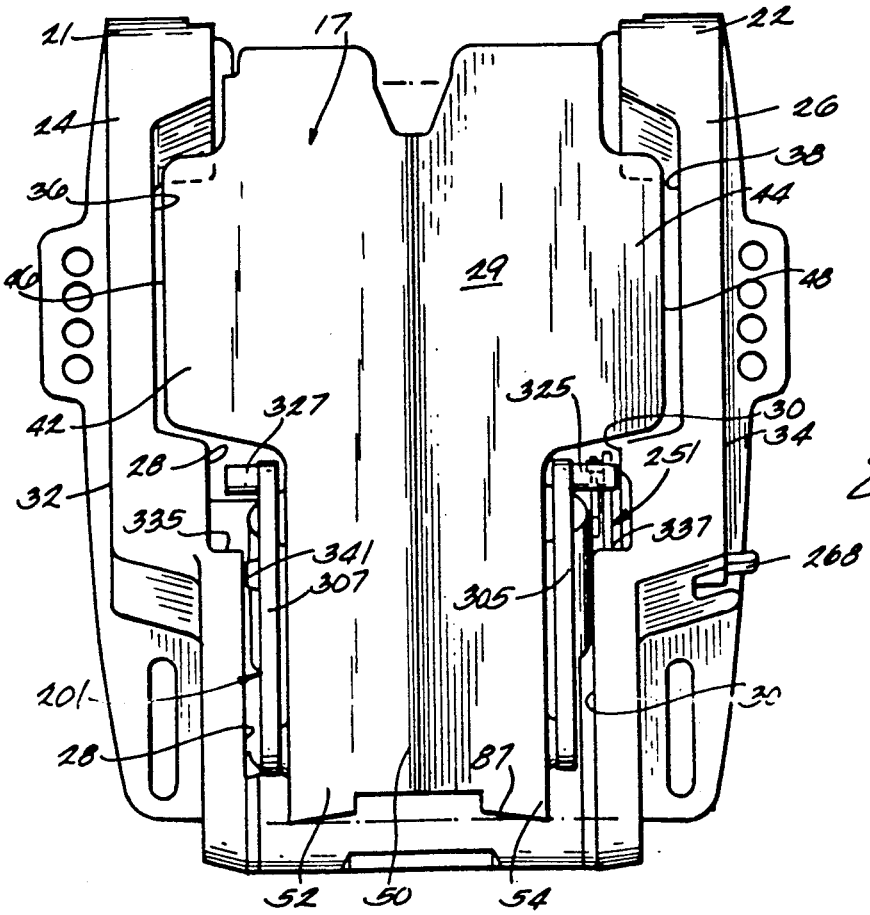
FIG. 20 is an enlarged view looking forwardly from the rear of the assembled swivel bracket, trail arm, and transom bracket.

Still more particularly as shown in FIGS. 20 and 21, the port and starboard transom bracket elements 21 and 22 include respective rearward surfaces 24 and 26 having respective laterally inner edges 28 and 30 and respective laterally outer edges 32 and 34. In addition, the inner lateral edges 28 and 32 include, centrally thereof, respective vertically elongated recesses 36 and 38 which materially diminished the width of the rearward surfaces 24 and 26. In addition, below the recesses 36 and 38, the rearward surfaces 24 and 26 include respective sockets, notches or recesses 335 and 337 which will be referred to again hereinafter and which are adapted to receive the outer end of a trail arm 201 still to be disclosed.

In addition, and also more particularly, (see FIG. 5) the swivel bracket 17 includes a horizontal leg 23 having a forward end through which the tilt axis 19 passes and a rearward end, as well as a generally vertical leg 25 which extends vertically downwardly from the rearward end of the horizontal leg 23 and which includes a vertically extending steering axis still to be described. The vertical leg 25 includes a transversely projecting central portion 27 having an unbroken rearward surface 29 which, in general, extends, when the swivel bracket 17 is in the trim range, between and adjacent the rearward surfaces 24 and 26 of the spaced transom bracket elements 21 and 22. The rearward surface 29 of the central portion 27 of the swivel bracket 17 includes (see FIG. 20) oppositely laterally outwardly projecting wings 42 and 44 which extend into the recesses 34 and 36 and into closely adjacent relation to the rearward surfaces 24 and 26 of the transom bracket elements 21 and 22 and include laterally spaced outer edges 46 and 48 extending in adjacent relation to the transom bracket rearward surfaces 24 and 26. In addition, the vertical leg 25 includes (see FIG. 5) a forward surface 31 and a pair of horizontally spaced forwardly projecting side surfaces or lugs 33 which respectively include aligned apertures rotatably supporting respective thrust rollers 143 still to be described. Still further, the swivel bracket includes a lower end or portion 50 having laterally spaced lower portions 52 and 54.

The outboard motor 11 also includes (see FIG. 1) a propulsion unit 51 which is connected to the swivel bracket 17 for common movement therewith about the tilt axis 19 and for pivotal movement relative to the swivel bracket 17 about a generally vertical steering axis 53 which has already been mentioned. The propulsion unit 51 comprises a powerhead 55 including an internal combustion engine 57, and a lower unit 59 including a drive shaft housing 61 which, at its upper end, is fixedly connected to the powerhead 55, which includes a forward portion 62 extending in closely adjacent relation to the rearward surface 29 of the central portion 27 of the swivel bracket 17, and which, at its lower end, is fixedly connected to a gearcase 63 rotatably supporting a propeller shaft 65 carring a propeller 67. The propeller shaft 65 is driven from the internal combustion engine 57 through a vertically extending drive shaft 69 within the drive shaft housing 61 and through a reversing transmission 71 located in the gear case 63 and connecting the drive shaft 69 to the propeller shaft 65.

Hydraulic means are provided for pivoting the swivel bracket 17 and connected propulsion unit 51 about the horizontal tilt axis 19 and relative to the transom bracket 13. While other constructions can be employed, in the illustrated construction, such means comprises (see FIGS. 3 and 21) a hydraulically actuated tilt and trim assembly 81. More specifically, in the disclosed construction, the hydraulic tilt and trim assembly 81 includes a hydraulic tilt cylinder/piston assembly 83 including a tilt cylinder 85 having a lower blind end pivotally connected to the transom bracket 13 about a first or lower horizontal axis 87, and a tilt piston rod 89 which extends from the other end of the tilt cylinder 85 and, at the outer end thereof, is pivotally connected to the swivel bracket 17 about a second or upper horizontal axis 91. The tilt cylinder/piston assembly 83 defines an axis 93 which extends generally vertically at all times throughout tilting movement of the swivel bracket 17 and connected propulsion unit 51 in the trim and tilt ranges, notwithstanding that the hydraulic tilt and trim assembly 81 pivots somewhat about the lower horizontal axis 87 in response to tilting movement of the swivel bracket 17.

The hydraulic tilt and trim assembly 81 also includes a pair of laterally aligned hydraulic trim cylinder/piston assemblies 95 which are respectively fixed to the tilt cylinder 85 on opposite sides thereof and which include respective trim cylinders 97 having blind or closed lower ends and open rearward and upper outer ends. Extending from the trim cylinders 97 are respective trim piston rods 99 having outer ends 101 which engage the swivel bracket 17 for forward thrust transmission when the swivel bracket 17 is in the trim range. The trim cylinder/piston assemblies 95 define respective axes 103 extending upwardly and rearwardly at an angle of about 30° to the axis 93 of the tilt cylinder/piston assembly 83. Because the trim cylinders 97 are fixed to the tilt cylinder 85, the trim cylinder/piston assemblies 95 are pivotal about the lower horizontal axis 87 in common with the tilt cylinder 85. Unlike the tilt cylinder 85, the outer ends 101 of the trim piston rods 99 are free of fixed connection with the swivel bracket 17 and, in fact, during swivel bracket movement through the tilt range, the outer ends 101 of the trim piston rods 99 are physically spaced from the swivel bracket 17.

Any suitable means can be provided for supplying hydraulic fluid to the tilt and trim cylinders 85 and 97 to effect movement of the tilt and trim piston rods 89 and 99. While other constructions can be employed, in the disclosed construction, the hydraulic tilt and trim assembly 81 includes (see FIG. 21) a reversible electric motor and pump sub-assembly 111 which is fixedly connected to the tilt cylinder 85 and which hydraulically connects with a sump or reservoir sub-assembly 115 which is also fixedly connected to the tilt cylinder 85. In particular, the tilt and trim assembly 81 includes a one-piece bracket or casting 121 which provides both the tilt cylinder 85 and the trim cylinders 97 and which includes mounting surfaces 123 and 125 to which the motor and pump sub-assembly 111 and the reservoir sub-assembly 115 are fixedly connected by any suitable means. In addition, a suitable conduit system (not shown) is provided internally of the tilt and trim assembly bracket 121.

Any suitable means can be employed to actuate the reversible electric motor and pump assembly 111. In the disclosed construction, such means comprises a two button switch (not shown) located at the port side of the outboard motor 11 and preferably mounted in (see FIG. 1) a lower motor cover or cowl 127.

The outboard motor 11 also includes means for transmitting forward thrust from the swivel bracket 17 to the trim piston rods 99 when the swivel bracket 17 is in the trim range, and notwithstanding variation in the angular location of the swivel bracket 17 relative to the transom bracket 13 and the angular location of the hydraulic tilt and trim assembly 81 relative to the transom bracket 13.

While other constructions can be employed, the disclosed construction is particularly adapted to minimize wear and, at the same time, improve the appearance of the outboard motor. More particularly, the outer end 101 of each of the trim piston rods 99 is provided with an enlarged head 131 having an outer abutment surface 133 which extends in a plane perpendicular to the trim piston axes 103. When the swivel bracket 17 is in the trim range, the enlarged heads 133 respectively engage thrust rollers 141 which are carried by the before mentioned projections or lugs 33 for rotary movement about a common horizontal axis 143. More particularly, each thrust roller 141 is rotatably supported on a shouldered stud or mounting bolt 145 which provides a cylindrical bearing surface and which is threaded into the associated one of the side surfaces or lugs 33. Preferably the cylindrical bearing surfaces are coated with a suitable film to minimum wear. Because the thrust rollers 141 are supported on the horizontally extending mounting bolts 145 which are threaded into the side surfaces or lugs 33, the thrust rollers 141 are readily accessible from the side for replacement by unthreading the mounting bolts 145 and when the propulsion unit is raised only slightly out of the trim range.

Because the side surfaces or projections or lugs 33 extend forwardly of the central swivel bracket portion 27, the rearward surface 29 of the central portion 27 of the swivel bracket 17 remains, as mentioned, unbroken and extends, in general (and as seen in FIG. 20), between and generally bridges and smoothly merges with the spaced transom bracket elements 21 and 22 and, in general, also extends in covering relation to the hydraulic tilt and trim assembly 81 when the swivel bracket is in the trim range.

Furthermore, the enlarged size of the heads 131 and the use of the thrust rollers 141 which engage the heads 131, and which are rotatable about the common horizontal axis 143 permit thrust transmission along a line of contact, as opposed to a point, thereby reducing wear, and provides rolling contact along the flat outer abutment surfaces 133 during relative movement between the trim piston rods 99 and the thrust rollers 141 resulting from movement of the swivel bracket 17 through the trim range, thereby also minimizing wear.

The outboard motor 11 also include means for selectively retaining the propulsion unit 51 in three positions within the tilt range, i.e., in a fully raised or full or high-tilt position at the upper end of the tilt range, in a low-tilt position angularly spaced below the full or high-tilt position, and in a less raised trail position angularly spaced below the low-tilt position, but above the trim range.

Figure 2:
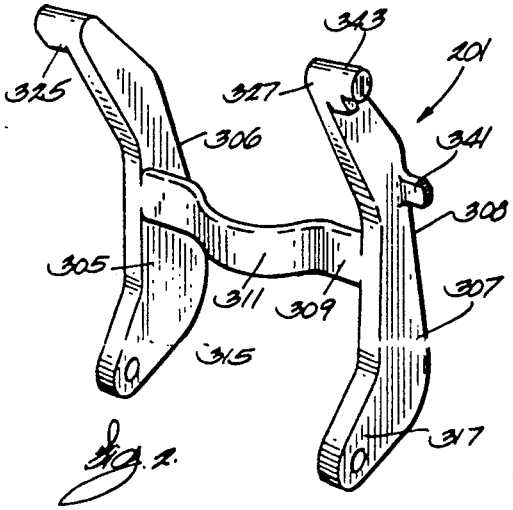
FIG. 2 is a perspective view of a trail arm incorporated in the marine propulsion device shown in FIG. 1.

The three position retaining means comprises (see FIG. 2) a trail arm 201 which will be described further hereinafter and which holds the propulsion unit 51 in the trail position, and means for selectively holding the propulsion unit 51 in the high-tilt and low-tilt positions.

Figure 11:
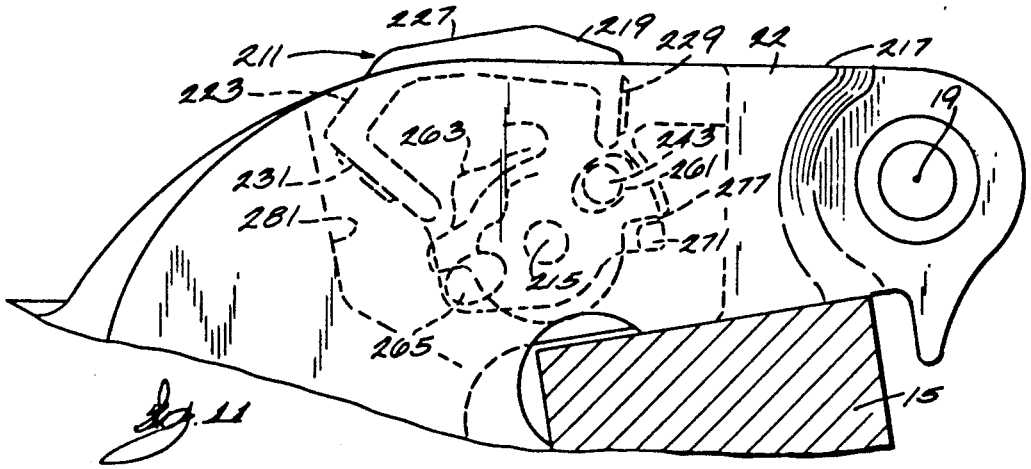
FIG. 11 is a further enlarged view of a portion of FIG. 3 and illustrates the disposition of the swivel bracket holding member when in a park position.
Figure 12:
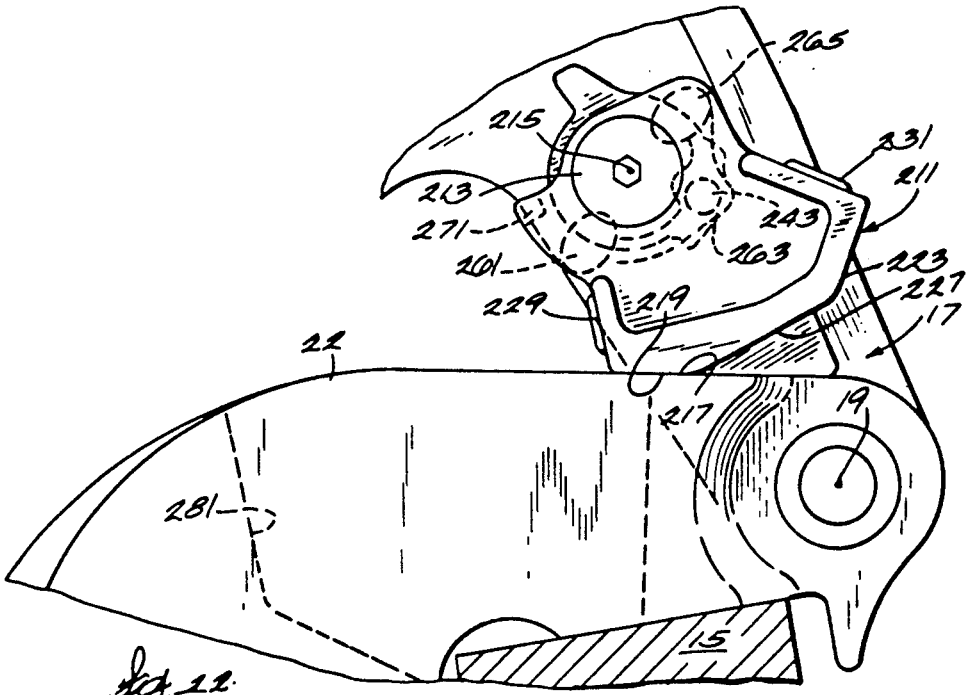
FIG. 12 is a view similar to FIG. 11 and illustrates the disposition of the swivel bracket holding member when in a low-tilt position.
Figure 13:
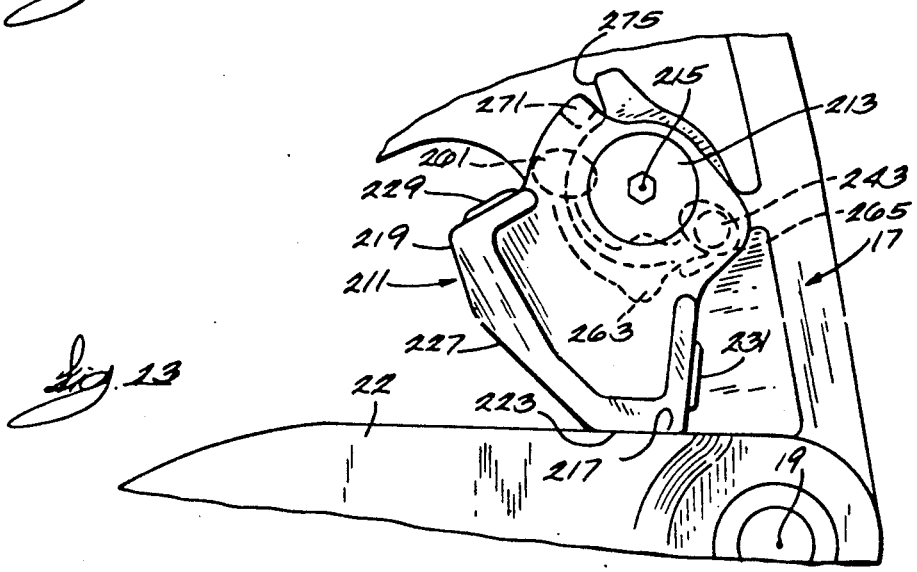
FIG. 13 is a view similar to FIGS. 11 and 12 and illustrating the disposition of the swivel bracket holding member when in the high-tilt position.
Figure 14:
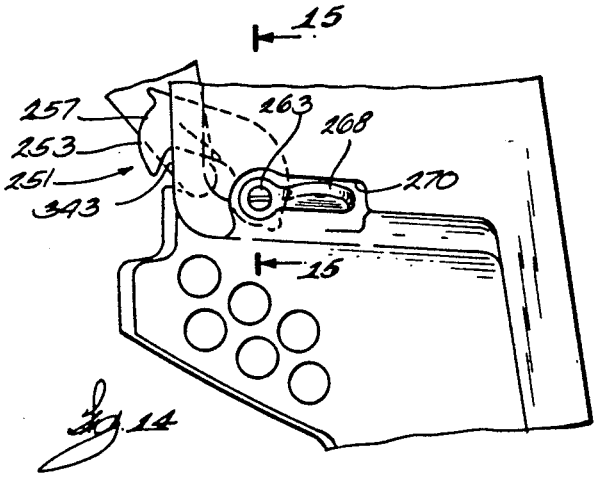
FIG. 14 is an enlarged side elevational view of a portion of the marine propulsion device shown in FIG. 1, which portion is also shown in FIG. 3.

While other constructions can be employed, the means for selectively holding the propulsion unit in the high and low-tilt positions includes (see FIGS. 5 through 13) a swivel bracket holding lever or member 211 which is mounted on one of the transom bracket 13 and the swivel bracket 17 for engagement with the other of the transom bracket 13 and swivel bracket 17 and which is moveable between three positions, i.e., a park or non-use position (see FIG. 11), a low-tilt position (see FIG. 12), and a high-tilt position (see FIG. 13).

Still more particularly, in the disclosed construction, the swivel bracket holding lever or member 211 is pivotally or rotatably carried by a mounting bolt or shouldered screw 213 received in (see FIG. 6) a mounting aperture 214 in the swivel bracket holding lever or member 211 and threaded into the starboard side of the upper leg 23 of the swivel bracket 17 for movement of the swivel bracket holding lever or member 211 about a horizontal pivot axis 215 and for movement into and in engagement with a portion 217 of the upper surface of the transom bracket 13.

Even more particularly, in the disclosed construction, the swivel bracket holding lever or member 211, except for the mounting aperture 214, is a solid piece, preferably of metal, and includes a low-tilt bearing surface 219 which is located, when the swivel bracket holding lever or member 211 is in the park position, generally above the mounting aperture 214 and in a plane 220 extending at a right angle to a radial plane 222 extending from the pivotal axis 215 and at a first or lesser distance from the pivotal axis 215.

Figures 5, 6, 7, 8, 9, 10:
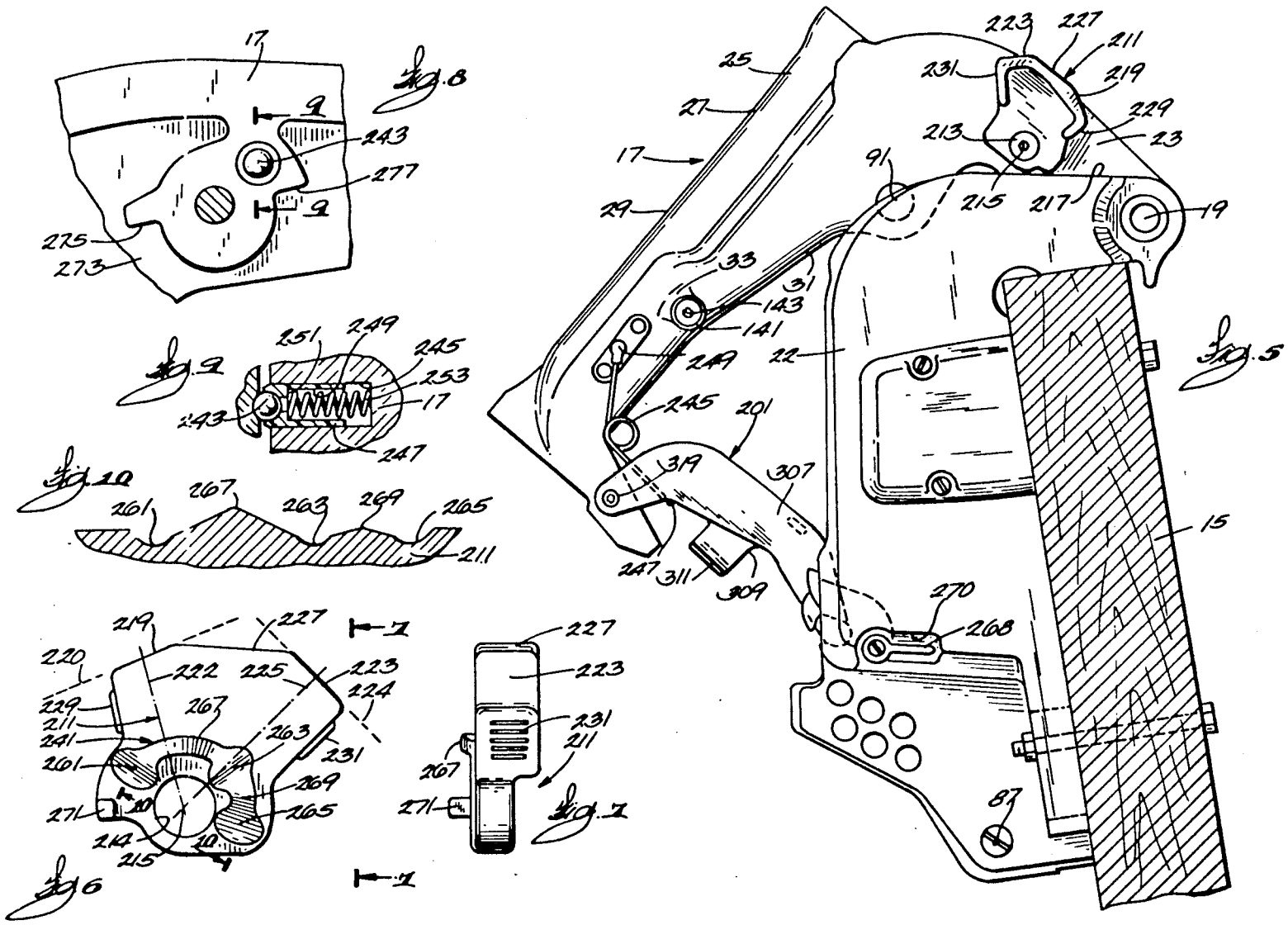
FIG. 5 is a further enlarged view similar to FIG. 3 and illustrating the swivel bracket in a trail position in which the trail arm is engaged with the transom bracket.
FIG. 6 is an enlarged view of the hidden side of a swivel bracket holding member which is also shown in FIG. 3.
FIG. 7 is an elevational view taken along line 7—7. of FIG. 6.
FIG. 8 is an elevational view in greater detail of a portion of the starboard side to the swivel bracket shown in FIG. 3.
FIG. 9 is a sectional view taken- along line 9—9 of FIG. 8.
FIG. 10 is enlarged sectional view taken along line 10—10 of FIG. 6.

The swivel bracket holding lever or member 211 also includes a high-tilt bearing surface 223 which is located in angularly spaced relation to the low-tilt surface 219 and which, when the swivel bracket holding lever or member 211 is in the park Position, is located generally above the pivotal axis 215, and in a plane 224 extending at a right angle to a radial plane 225 extending from the pivotal axis 215 and at a second or greater distance from the pivotal axis 215 than the first distance. The adjacent ends of the low and high-tilt bearing surfaces 219 and 223 are connected by a non-bearing surface 227 extending, when the swivel bracket holding lever or member 211 is located in the park position, generally above the pivotal axis 215. Extending from the other end of the low-tilt bearing surface 219 remote from the non-bearing surface 227 is a finger pad 229 adapted for engagement by the finger of an operator for rotating the swivel bracket holding lever or member 211 in the counterclockwise direction as shown in FIG. 5. Extending from the other end of the high-tilt bearing surface 223 remote from the non-bearing surface 227 is another finger pad 231 adapted for engagement by the finger of an operator for rotating the swivel bracket holding lever or member 211 in the clockwise direction as shown in FIG. 5.

Also provided are detent means for releasably retaining the swivel bracket holding lever or member 211 in a selected one of the park, low-tilt, and high-tilt positions. While other constructions can be employed, the disclosed construction comprises (see FIG. 6) a cam track or surface 241 on one of the swivel bracket 17 and the swivel bracket holding lever or member 211, and (see FIGS. 8 and 9) a detent ball 243 carried by the other of the swivel bracket 17 and the swivel bracket holding lever or member 211. In the specifically disclosed construction, the cam track 241 extends arcuately around the mounting aperature 214 or pivotal axis 215 on the hidden side of the swivel bracket holding lever or member 211, i.e., on the side adjacent the swivel bracket 17, and the detent ball 243 is carried by the swivel bracket 17.

Means are also provided for biasing the detent ball 243 toward the cam track or surface 241. While other constructions can be employed, in the disclosed construction, the swivel bracket 17 includes (see FIG. 9) a bore 245 which is located in spaced relation to the pivot axis 215, and which receives a detent ball retainer or carrier 247 which supports the detent ball 243 and which includes an inwardly open bore 249 with an internal shoulder 251. Located within the bore 249 is a coil spring 253 which, at one end, bears against the swivel bracket 17 and which, at the other end, bears against the internal shoulder 251, thereby biasing the detent ball carrier 247 out of the bore 245 in the swivel bracket 17 so as to pressingly engage the detent ball 243 against the cam track 241.

Still more particularly, as shown best in FIGS. 6 and 10, the cam track 241 includes three angularly spaced recesses, i.e., a park recess 261, a low-tilt recess 263, and a high-tilt recess 265, which recesses 261, 263, and 265 are adapted to releasably receive the detent ball 243 when the swivel bracket holding lever or member 211 is in the associated position. Located between the recesses 261, 263, and 265 are two cam track peaks 267 and 269 which serve to selectively bias the swivel bracket holding lever toward a selected one of the three positions depending upon the location of the swivel bracket holding lever or member 211.

Means are also provided for limiting rotation of the swivel bracket holding lever or member 211 relative to the swivel bracket 17. While other arrangements can be employed, in the disclosed construction, one of the swivel bracket holding lever or member 211 and the swivel bracket 17 includes (see FIGS. 6 and 7) a stud 271 extending into (see FIG. 8) a void or recess 273 in the other of the swivel bracket holding lever or member 211 and the swivel bracket 17. Still more particularly, in the specifically disclosed construction, the swivel bracket holding lever or member 211 includes the stud 271 which extends from the hidden side, which is located in spaced relation to the cam track 241, and which extends into the void or recess 273 in the swivel bracket 17 defined, in part, by spaced walls 275 and 277 which, incident to swivel bracket holding lever rotation, are engaged by the stud 271 to limit such rotation so as to prevent movement of the swivel bracket holding lever or member 211 beyond the range providing the three positions.

Because the axis 215 of the swivel bracket holding lever or member rotation is spaced downwardly from the top of the swivel bracket 17, the major portion of the swivel bracket holding lever or member 211 is hidden from view in (see FIG. 11) a recess 281 in the adjacent starboard transom bracket element 22 when the propulsion unit 51 is in a running position and the swivel bracket holding lever or member 211 is in the park position. However, when the propulsion unit 51 is raised or tilted upwardly, as for instance by the tilt cylinder/piston assembly 83, the swivel bracket holding lever or member 211 becomes accessible by the operator and is selectively engageable with the top surface portion 217 of the starboard transom bracket element 22, just forwardly of the recess 281. More particularly, the operator can engage the finger pads 229 and 231 of the swivel bracket holding lever or member 211 to rotate the swivel bracket holding lever or member 211 in the appropriate direction as may be desired. Of course, during such rotation, the propulsion unit 51 is raised, as for instance by the tilt cylinder/piston assembly 83, so as to disengage the appropriate one of the bearing surfaces 219 and 223 from the starboard transom bracket element 22 and to elevate the swivel bracket 17 sufficiently above the upper surface portion 217 of the starboard transom bracket element 22 to facilitate such movement as desired.

The outboard motor 11 also includes, as part of three position retaining means, means for holding the propulsion unit 51 in the before mentioned trail position within the tilt range, but below the two tilt positions, i.e., below the low-tilt and high-tilt positions. In the disclosed construction, the holding means positively prevents "bouncing" of the propulsion unit 51 relative to the transom bracket 13.

More particularly, while other constructions can be employed, in the disclosed construction, such holding means includes (see FIGS. 2 and 5) pivotal mounting on the swivel bracket 17 of the before mentioned trail arm 201 which is moveable between a retracted position and an extended trail position in which an outer end or foot of the trail arm 201 is engaged in a socket, notch or recess in the transom bracket 13 so as to locate the propulsion unit 51 in a desired trail angle relative to the transom bracket 13. Such holding means also includes latch means for releasably retaining the outer end or foot of the trail arm 201 in the recess, and thereby preventing "bouncing."

Still more particularly, while other constructions can be employed, the trail arm 201 (see FIG. 2) is preferably integrally formed to include two laterally spaced and parallel arm portions 305 and 307 which respectively include edge surfaces 306 and 308 and which are integrally connected centrally thereof by a cross portion 309 including a arcuately curved central part 311 permitting close adjacent relation of the trail arm 201 to the forward surface 31 of the central portion 29 of the swivel bracket 17 when the trail arm 201 is in the retracted position.

Still more particularly, the arm portions 305 and 307 respectively include aligned lower or rearward ends 315 and 317 which are respectively pivotally mounted by suitable respective bolts 319 (one shown in FIG. 5) to the laterally spaced lower portions 52 and 54 of the lower end 50 of the swivel bracket 17. When in the retracted position, the trail arm 201 extends upwardly from the lower end of the swivel bracket 17 into close association therewith. When in such retracted position, the edge surfaces 306 and 308 face rearwardly and substantially occupy (as shown in FIG. 21) the space between the lower end 50 of the swivel bracket 17 and the lower part, below the recesses 34 and 36, of the laterally inner edges 28 and 30 of the transom bracket elements or portions 21 and 22. The arm portions 305 and 307 also respectively include outer ends 325 and 327 which, when the trial arm 201 is in the extended trail position, are received and releasably held in cooperating sockets, recesses or notches 335 and 337 respectively formed in the spaced transom bracket elements 21 and 22. In addition, the arm portion 309 includes a finger tab 341 facilitating movement of the trail arm 201 by an operator from the retracted position to the extended trail position.

Means are provided for biasing the trail arm 201 to the retracted position. While other constructions can be employed, in the disclosed construction, such biasing means comprises (see FIG. 5) a coil spring 245 having a first end 247 bearing against the trail arm 201 and a second end 249 which is suitably anchored to the swivel bracket 17.

While other constructions can be employed, in the disclosed construction, the means for releasably holding or retaining the trail arm 201 in supported engagement with the transom bracket 13 comprises, on the trail arm 201, a projection or lug 243 extending laterally from the outer end 327 of the arm portion 307, and (see FIGS. 14 through 19) a latch member or keeper 251 which is pivotally mounted on the starboard transom bracket element. 22 adjacent the socket or notch 337 for movement relative to a retaining position. The latch member 251 includes an outer hook portion 253 which is defined by a blocking or retaining surface 255 and by a camming surface 257. When in the retaining position, the retaining surface 255 extends into blocking or interfering relation to the path of withdrawal of the laterally extending projection or lug 243, and thereby positively retains the trail arm 201 from removal from the socket or notch 337.

Means are provided for biasing the latch member or keeper 251 in the counter-clockwise direction (as shown in FIGS. 16 through 19) and into the retaining position. While other constructions can be employed, in the disclosed construction, such means comprises a helical coil spring 261 having one end 262 engaged with the latch member 251 and having another end 264 bearing against the transom bracket 13.

Figure 15:
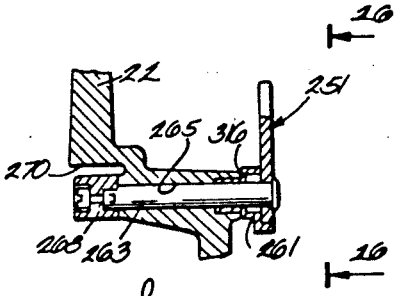
FIG. 15 is a sectional view taken along line 15—15 of FIG. 14.

Still more particularly (and as shown in FIG. 15), the latch member 251 is fixed to a latch shaft 263 which extends through a suitable horizontal aperture or bore 265 in the starboard transom bracket element 22 and which, at the outer end thereof, has fixed thereon a handle 268 facilitating movement of the latch member 251 from the retracted position. Preferably, the starboard transom bracket element 22 includes (see FIGS. 1, 5, and 14) a recess 270 which, when the latch member 251 is in the retracted position, substantially encloses or houses the latch lever handle 268.

Figure 17:
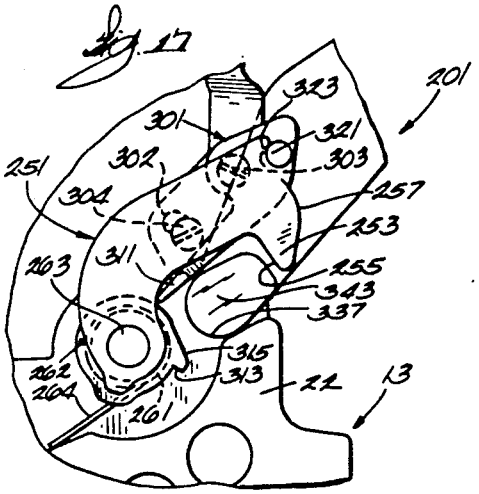
FIG. 17 is a view similar to FIG. 16 and illustrates the latch member in engaged or latched position preventing withdrawal of the trail arm from the transom bracket.
Figure 16:
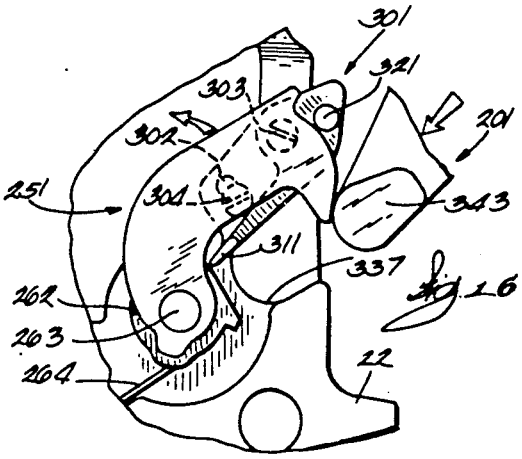
FIG. 16 is an enlarged fragmentary view illustrating the disposition of various components during insertion of the trail arm shown in FIG. 2 into a socket provided in the transom bracket.

Thus, the latch member 251 is generally located, when in the retaining position, in the path of movement of the projection or lug 243 on the trail arm 201. When the trail arm 201 is in the extended trail position and located for entry into the supporting notch, socket, or recess 337, engagement of the projection or lug 243 with the camming surface 257 serves to pivotally displace the latch member 251 from the retaining position in the counter-clockwise direction, as seen in FIG. 16, and out of the path of the projection or lug 243 during insertion of the outer end or foot 327 of the trail arm 201 into the socket, recess, or notch 337. Upon full insertion of the outer end or foot 327 into the socket, recess, or notch 337, the latch member 251 rotates in the clockwise direction, as shown in FIG. 17, to the retaining position in interfering engagement with the path of travel of the projection or lug 243 incident to withdrawal of the outer end or foot 327 from the supporting socket, recess, or notch 337, thereby positively retaining the trail arm 201 in the notch 337.

Means are also provided for releasably retaining the latch member 251 in a retracted position spaced from the retaining position and against the action of the biasing spring 261, and for releasing the latch member 251 from the spaced position incident to withdrawal of trail arm 201 from the socket, recess, or notch 337, thereby permitting action of the spring 261 to return the latch member 251 to its normal retaining position.

While other constructions can be employed, in the disclosed construction, such means comprises (See FIGS. 16 through 19) a detent lever 301 which is mounted on the starboard transom bracket element 22 for pivotal movement about a fixed pin 303 between a first position extending slightly into the path of movement of the outer end or foot 327 of the trail arm 211 and a second position spaced from the first or extending position and out of the socket, recess, or notch 337. Pivotal movement of the detent lever 301 between its two positions is limited to a relatively small arc by reason of a short slot 302 provided in the detent lever 301 and a fixed pin 304 which extends through the slot 302 and into the starboard transom bracket element 22.

The means for releasably retaining the latch member 251 in the retracted position also includes means on the detent member 301 and on the latch member 251 for holding the latch member 251 in the retracted position when the detent lever 301 is in a position at least partially extending into the socket or notch 337 and into engagement with the outer end or foot 327 when the outer end or foot 327 of the trail arm 201 in the socket, recess, or notch 337. While other constructions can be employed, in the disclosed construction, such means comprises formation of the detent member 301, adjacent the lower end thereof, with a thin outwardly projecting finger or tang 311 which integrally extends resiliently and flexibly from the detent member 301. In addition, such means also includes, on the latch member 251, a stop surface 313 extending radially outwardly with respect to the axis of pivotal latch member movement, and a camming surface 315 leading to the outer end of the stop surface 313. More particularly, the camming surface 315 is formed (See FIG. 15) on a bushing 316 which encircles the latch member shaft 263 and is fixed against movement relative to the latch member 251.

Figure 18:
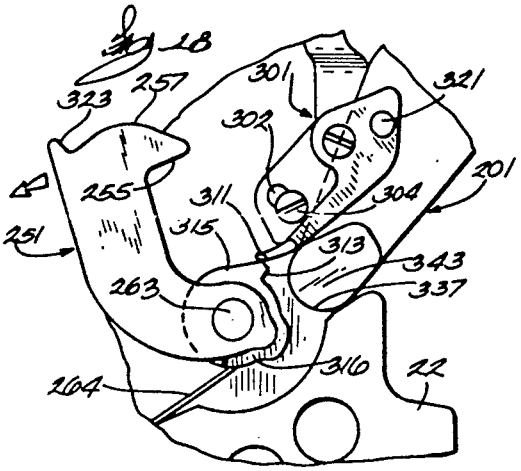
FIG. 18 is a view similar to FIGS. 15 and 16 and illustrates displacement of the latch member away from the engaged or latched position.
Figure 19:
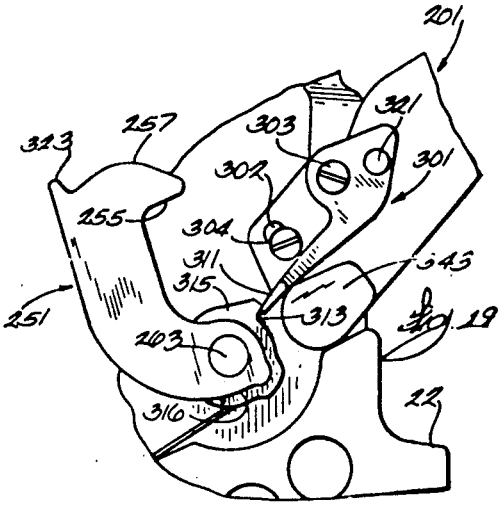
FIG. 19 is a view similar to FIGS. 16, 17, and 18 and illustrates the latch member in the retracted position affording withdrawal of the trail arm from engagement with the transom bracket.

When the trail arm 201 is located with the outer end or foot 327 thereof in the socket, recess, or notch 337, and when the detent member 301 is in the position extending at least partially into the recess 337 and in engagement with the trail arm 201, and an operator desires to unlatch the trail arm 201 from the starboard transom bracket element 22, the latch member handle 268 is actuated to rotate the latch member 251 in the counter-clockwise direction, as seen in FIG. 18, for about 135° from the retaining position. Such action initially causes engagement of the outer end of the finger 311 with the camming surface 315, causing the finger 311 to flex or bend from the normal outwardly extending position and relative to the main body of the detent member 301, and to ride up the camming surface 315 toward the outer end of the stop surface 313. Continued movement of the latch member 251 in the counter-clockwise direction, as shown in FIGS. 18 and 19, causes the finger 311 to ride off the camming surface 315 and to travel past the stop surface 313 and to return to the normal outwardly extending position. When the latch member handle 267 is released, the spring 261 causes latch member clockwise movement, as shown in FIG. 19, until the stop surface 313 is engaged by the finger 311. Such engagement prevents further movement of the latch member 251 toward the retaining position, retains the latch member 251 in substantially spaced position from the retaining position, and displaces the detent member 301 into relatively tight engagement with the projection or lug 243. The components will retain these positions as long as the outer end or foot 327 of the trail arm 201 is located in the socket, recess, or notch 337.

However, when and if the tilt cylinder/piston assembly 83 is actuated to raise the propulsion unit 51 above the trail position, such action, because the latch member 251 is not in the retaining position, will cause withdrawal of the outer end or foot 327 of the trail arm 201 from the socket, recess, or notch 337. Such withdrawal releases the engagement of the projection or lug 243 with the detent member 301 and permits movement of the detent member 301 into the extending position in the socket, recess, or notch 337. Such movement of the detent member 301 withdraws the engagement of the finger 311 with the stop surface 313, whereupon the spring 261 causes the latch member 251 to pivot in the counter-clockwise direction, as shown in FIGS. 17 through 19, into the retaining position shown in FIG. 17. The components are now again ready to accept the trail arm 201 when it is next desired to retain the propulsion unit 51 in the trail position. The latch member handle 268 is also again located in the recess 270 on the exterior surface of the starboard transom bracket element 22.

Means are provided for limiting movement of the latch member 251 in the clockwise direction as shown in FIGS. 16 through 19 to the retaining position shown in FIG. 17 under the influence of the spring 261. While other constructions can be employed, in the disclosed construction such means comprises a stud 321 on the upper end of the detent member 301 and an ear or shoulder 323 located on the latch member or keeper 251 at the outer end of the camming surface 257.

Various of the features of the invention are set forth in the following claims.

We claim:

1. A marine propulsion device comprising a transom adapted to be mounted on a boat transom, a swivel bracket supported from said transom bracket for pivotal movement about a horizontal tilt axis and relative to a trim range and a tilt range extending upwardly from the trim range, a thrust roller supported by said swivel bracket for rotation about a horizontal axis parallel to said tilt axis, a tilt cylinder/piston assembly pivotally connected to said swivel bracket and to said transom bracket; a trim cylinder/piston assembly fixed to said tilt cylinder piston assembly for common pivotal movement therewith relative to said transom bracket and including a trim cylinder and a trim piston rod extending from said trim cylinder and having an outer end surface engageable with said thrust roller throughout movement of said swivel bracket in the trim range, and a propulsion unit supported by said swivel bracket for common movement therewith about said tilt axis and for pivotal steering movement relative to said swivel bracket about a steering axis transverse to said tilt axis and including a propeller shaft adapted to have mounted thereon a propeller.

2. A marine propulsion device in accordance with claim 1 wherein said swivel bracket includes a projection extending forwardly therefrom, and wherein said thrust roller is supported by said projection by means accessible from the side of said swivel bracket for effecting removal and replacement of said roller.

3. A marine propulsion device comprising a transom bracket adapted to be mounted on a boat transom, a swivel bracket supported from said transom bracket for pivotal movement about a horizontal tilt axis and relative to a trim range and a tilt range extending upwardly from the trim range, a thrust roller supported by said swivel bracket for rotation about a horizontal axis parallel to said tilt axis, a trim cylinder/piston assembly supported by said transom bracket and including a trim cylinder and a trim piston rod extending from said trim cylinder and having an axis, an inner portion having a size, and an outer portion located outwardly from said inner portion and having an outer end surface engageable with said thrust roller throughout movement of said swivel bracket in the trim range, said outer end surface being of a size larger than said size of said inner portion, being flat, and extending perpendicularly to said axis, and a propulsion unit supported by said swivel bracket for common movement therewith about said tilt axis and for pivotal steering movement relative to said swivel bracket about a steering axis transverse to said tilt axis and including a propeller shaft adapted to have mounted thereon a propeller.

4. A marine propulsion device comprising a transom bracket adapted to be mounted on a boat transom, a swivel bracket supported from said transom bracket for pivotal movement about a horizontal tilt axis and relative to a trim range and a tilt range extending upwardly from the trim range, said swivel bracket having a rearward surface and a side extending forwardly from said rearward surface, a thrust roller supported by said swivel bracket for rotation about a second horizontal axis parallel to said tilt axis, said roller being supported by said swivel bracket by means moveable along said second horizontal axis to enable removal and replacement of said roller, a trim cylinder/piston assembly supported by said transom bracket and including a trim cylinder and a trim piston rod having an outer end surface engageable with said thrust roller throughout movement of said swivel bracket in the trim range, and a propulsion unit supported by said swivel bracket for common movement therewith about said tilt axis and for pivotal steering movement relative to said swivel bracket about a steering axis transverse to said tilt axis and including a propeller shaft adapted to have mounted thereon a propeller.

5. A marine propulsion device comprising a transom bracket adapted to be mounted on a boat transom, and including a pair of laterally spaced elements, a swivel bracket supported from said transom bracket for pivotal movement about a horizontal tilt axis and through a trim range and a tilt range extending upwardly from the trim range, said swivel bracket including a portion which extends generally vertically when said swivel bracket is in the trim range, said portion including an unbroken rearward surface extending between said transom bracket elements, and a pair of projections extending forwardly therefrom in laterally spaced relation to each other, a pair of rollers respectively supported by said projections for rotation about a common horizontal axis parallel to said tilt axis, a hydraulic tilt and trim assembly comprising a tilt hydraulic cylinder/-piston assembly comprising a tilt cylinder pivotally connected to said transom bracket and a tilt piston rod pivotally connected to said swivel bracket, and a pair of trim hydraulic cylinder/piston assemblies fixedly connected to said tilt cylinder on opposite sides thereof and for common movement therewith, and respectively comprising a trim cylinder and a trim piston rod extending from said trim cylinder, said trim position rods respectively extending toward said rollers and being engageable therewith when said swivel bracket is in the trim range and being spaced therefrom when said swivel bracket is in the tilt range, and a propulsion unit supported by said swivel bracket for common movement therewith about said tilt axis and for pivotal steering movement relative to said swivel bracket about a steering axis transverse to said tilt axis and including a propeller shaft adapted to have mounted thereon a propeller.

6. A marine propulsion device in accordance with claim 5 wherein said rollers are supported from said projections by means accessible from the side of said swivel bracket for effecting removal and replacement of said rollers.

7. A marine propulsion device in accordance with claim 5 wherein said trim piston rods each includes an inner portion having a size, and an outer portion located outwardly from said inner portion and having an outer end surface engageable with said rollers throughout movement of said swivel bracket in the trim range, said outer end surface being of a size larger than said size of said inner portion, and being flat.

8. A marine propulsion device in accordance with claim 5 wherein said swivel bracket has opposite sides extending forwardly from said rearward surface, and wherein said rollers are supported from said swivel bracket projections by means accessible from said sides of said swivel bracket for effecting removal and replacement of said rollers.

* * * * *